United States Patent [19]

Geertsma

[11] Patent Number: 4,468,898

[45] Date of Patent: Sep. 4, 1984

[54] BUILDING SYSTEM

[76] Inventor: Nicolaas A. Geertsma, van Limburg Stirumweg 6, 6861 WL Oosterbeek, Netherlands

[21] Appl. No.: 361,984

[22] Filed: Mar. 25, 1982

[30] Foreign Application Priority Data

Mar. 31, 1981 [NL] Netherlands ..... 8101589

[51] Int. Cl.[3] ..... E04B 1/00

[52] U.S. Cl. ..... 52/36; 52/309.11; 52/270; 52/690

[58] Field of Search ..... 52/36, 18, 73, 79.12, 52/92, 93, 238, 290, 270, 264, 309.11, 690

[56] References Cited

U.S. PATENT DOCUMENTS

| | | | |
|---|---|---|---|
| 419,056 | 1/1890 | Mercer | 52/92 X |
| 1,738,854 | 12/1929 | Thies | 52/18 |
| 2,226,332 | 12/1940 | Bacci . | |
| 2,376,653 | 5/1945 | Boyer | 52/309.11 X |
| 2,648,877 | 8/1953 | Vermilya . | |
| 2,883,711 | 4/1959 | Kump | 52/270 X |
| 3,008,195 | 11/1961 | Coffey | 52/93 |
| 3,462,897 | 8/1969 | Weinrott | 52/309.11 X |
| 3,623,288 | 11/1971 | Horowitz | 52/264 |
| 3,774,362 | 11/1973 | Mastuchek et al. | 52/264 X |

FOREIGN PATENT DOCUMENTS

| | | | |
|---|---|---|---|
| 1918321 | 10/1970 | Fed. Rep. of Germany | 52/92 |
| 1937353 | 2/1971 | Fed. Rep. of Germany . | |
| 2207955 | 8/1973 | Fed. Rep. of Germany | 52/79.12 |
| 533315 | 5/1923 | France . | |
| 613230 | 11/1926 | France . | |
| 870172 | 3/1942 | France . | |
| 1364670 | 5/1964 | France | 52/92 |
| 935852 | 9/1963 | United Kingdom | 52/18 |

*Primary Examiner*—Carl D. Friedman

*Attorney, Agent, or Firm*—Dennison, Meserole, Pollack & Scheiner

[57] ABSTRACT

Building system in which the supporting elements are formed by partitions or plates (1–16) one group of plates (1,2,3,4) being placed in spaced apart parallel vertical planes with all plates (1,2,3,4) of said group having the same width in horizontal direction which width corresponds to the width of a cupboard the plates (1,2,3,4) of said group being placed between at least two vertical plates (9,10) which extend perpendicular to the plates of the first group. Preferably a third plate (18) or group of plates is placed in a horizontal plane between the vertical plates.

9 Claims, 5 Drawing Figures

BUILDING SYSTEM

The invention is related to a building system comprising supporting elements, wall panels and roof panels and/or other construction means. Such building systems are known in several designs. Usually they comprise columns and beams that form mutually perpendicular portals between which the wall or wall panels are positioned, that may support the beams of a ceiling or a roof construction respectively.

The aim of the invention is to provide a building system that is very simple, if desired may consist of one single material, can be erected by unskilled people and for that reason is particularly suitable for application in developing countries, as holiday home and so on.

According to the invention this aim is obtained by the fact that the supporting elements comprise sheets that at one or more places of the building construction are combined in the manner of a cupboard wall to a supporting element comprising a number of vertical partitions or plates of the same width and height, that are erected at distances from each other and parallel to each other and that at at least one place are fixedly connected between two vertical plates that are perpendicular to the vertical partitions and are parallel to each other. The partitions that are vertically positioned are able to take up the forces and moments present in the plane of their sheets. With the two perpendicularly thereon positioned plates, that are fixedly connected to the partitions and so have a connection along the height of the plates, the partitions are mutually coupled and a possible reinforcement is alreay obtained of the combination of partitions and plates against bending in a direction perpendicular to the partitions.

With the aid of this base element, that so exclusively comprises vertical partitions that are clamped between two vertical plates, which base element is rigid in planes that are perpendicular to each other, it is possible to make in combination with wall panels a great number of buildings that are suited for living and such aims, in particular in case at least two of these base elements are positioned perpendicular to each other and are mutually coupled. The distance between the two plates and therewith the horizontal width of the partitions in a sense corresponds with the depth of a cupboard. Cupboard depth is a variable idea. In a book cupboard only some decimeters are in question and in a cloth cupboard greater dimensions are in question such as 60 to 80 centimeters. The supporting element according to the invention is concerning its cupboard depth within this reach and this also is the reach within which the rigidity in the plane of the sheet still gives sufficient strength to such a special supporting element. A comparitive consideration holds for the distance between the vertical partitions. This distance is a distance as appears in great variety with the width of cupboards.

Preferably the plates are connected to the upper end of the partitions, for instance at the height of the upper cupboards in a cupboard wall.

So one can see the invention as the insight that cupboard walls known in building constructions loose form the support construction already a long time are used as single supporting element of the construction. Each supporting element may obtain a greater strength in case at least two vertical partitions of a supporting element are mutually connected by a plate perpendicular to the partitions. The bending of the high partitions in a direction perpendicular to the planes of it, is completely taken up by the rigidity of the plate present between the partitions.

In case one still provides between the two plates a horizontal plate that is fixedly connected to the plate, the element also has obtained torsional strength for plates are present in three mutually perpendicular positioned planes and these are, at those places where it is necessary, for rigidity mutually coupled.

The principle which forms the basis of the invention makes it possible, in case this is desired, to design partitions and plates with the same thickness. In that case the building can be composed from plates or panels that are prefabricated with the correct dimensions, and are made out of one and the same material. This can be massive panels, also hollow panels, possibly filled with an insulation material, or a sandwich panel, that comprises isolating layers.

The invention will be elucidated with reference to the drawing.

Figure 1:
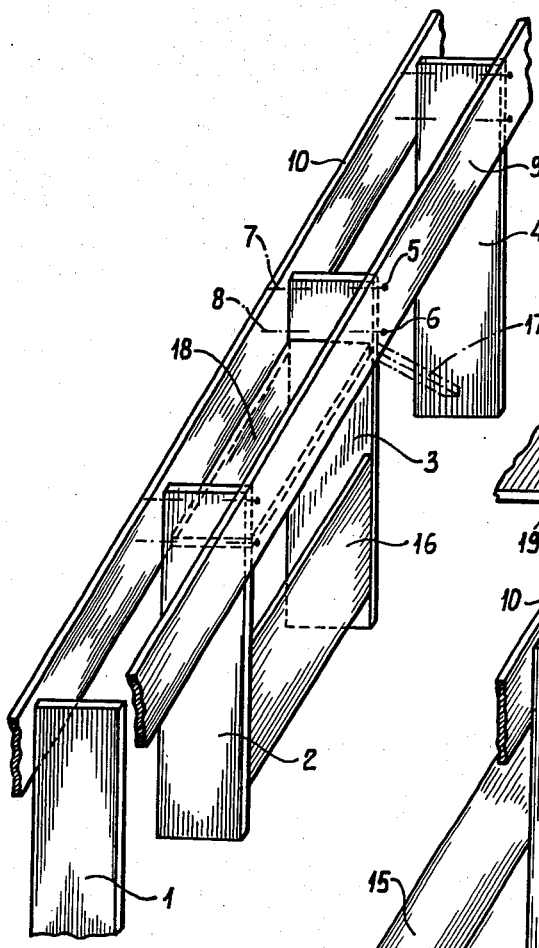
FIG. 1 shows in perspective a supporting element of the building system according to the invention.
Figure 2:
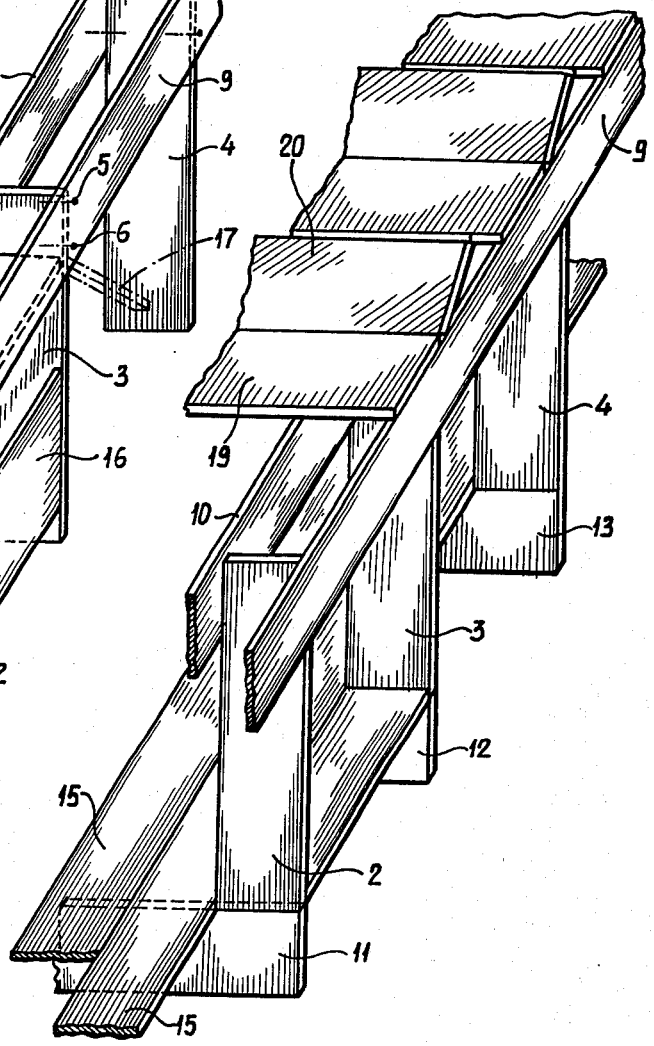
FIG. 2 is a variant of FIG. 1.

In the FIGS. 1 and 2 a supporting element is shown comprising vertical partitions 1, 2, 3 and 4. These partitions all have the same dimensions.

The upper ends of the partitions 1 to 4 inclusive are for instance with the aid of bolts 5 and 6 or 7 and 8 respectively clamped between two mutually parallel plates 9 and 10 having in essence the same length and the same height.

The partitions 1 to 4 inclusive are in one or another suitable manner connected to a foundation, that is not shown in FIG. 1.

FIG. 2 shows that these partitions can be connected with the upper side of the beams 11, 12 and 13, that also support the floor boards. The element comprising partitions 1 to 4 inclusive and plates 9 and 10 may obtain in the direction of the planes of the plates 9 and 10 a higher stiffness in case on at least one place a further flat plates 16 is provided as for instance shown in FIG. 1, between the partitions 2 and 3. This avoids bending of the partitions when loaded in a direction perpendicular to the planes of the partitions. Instead of the plate 16 it is of course also possible to provide rigidity in another way, for instance in the shape of an inclined brace 17.

For uniformity of the building system, however, it is desired to use exclusively plate shaped elements.

Moreover between the plates 9 and 10 still a rigidity can be given in the shape of a plate 18, that avoids that the plates 9 and 10 may move with regard to each other and therefore give torsion rigidity to the whole.

In its most complete shape the supporting element therefore comprises flat plates in three mutually perpendicular planes and obtains the element its stability and strength exclusively from the rigidity and strength of the plates in the plane of the plates, in which the deformation of the plates perpendicular to the plane is taken up by the rigidity of a plate that is perpendicular thereto.

Further FIG. 2 shows that it is possible to mount a simple roof construction in the shape of plates 19 and 20 of which the plates 19 are in a horizontal plane and the plates 20 are erected as a roof. These roof plates in principle can be of the same type as the parts of the supporting element.

Figure 3:
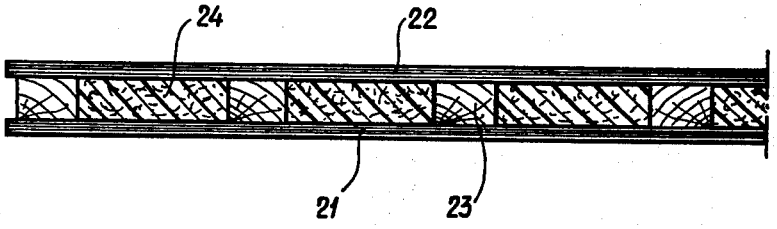
FIG. 3 is a sectional detail through one type of component which may be used in the construction of the supporting element.

FIG. 3 is a section of a possible construction of a partition or plate comprising thin sheets 21 and 22 between which laths 23 are present and hollow spaces 24 which latter can be filled with isolating material, for instance a foamed plastic.

Figure 4:
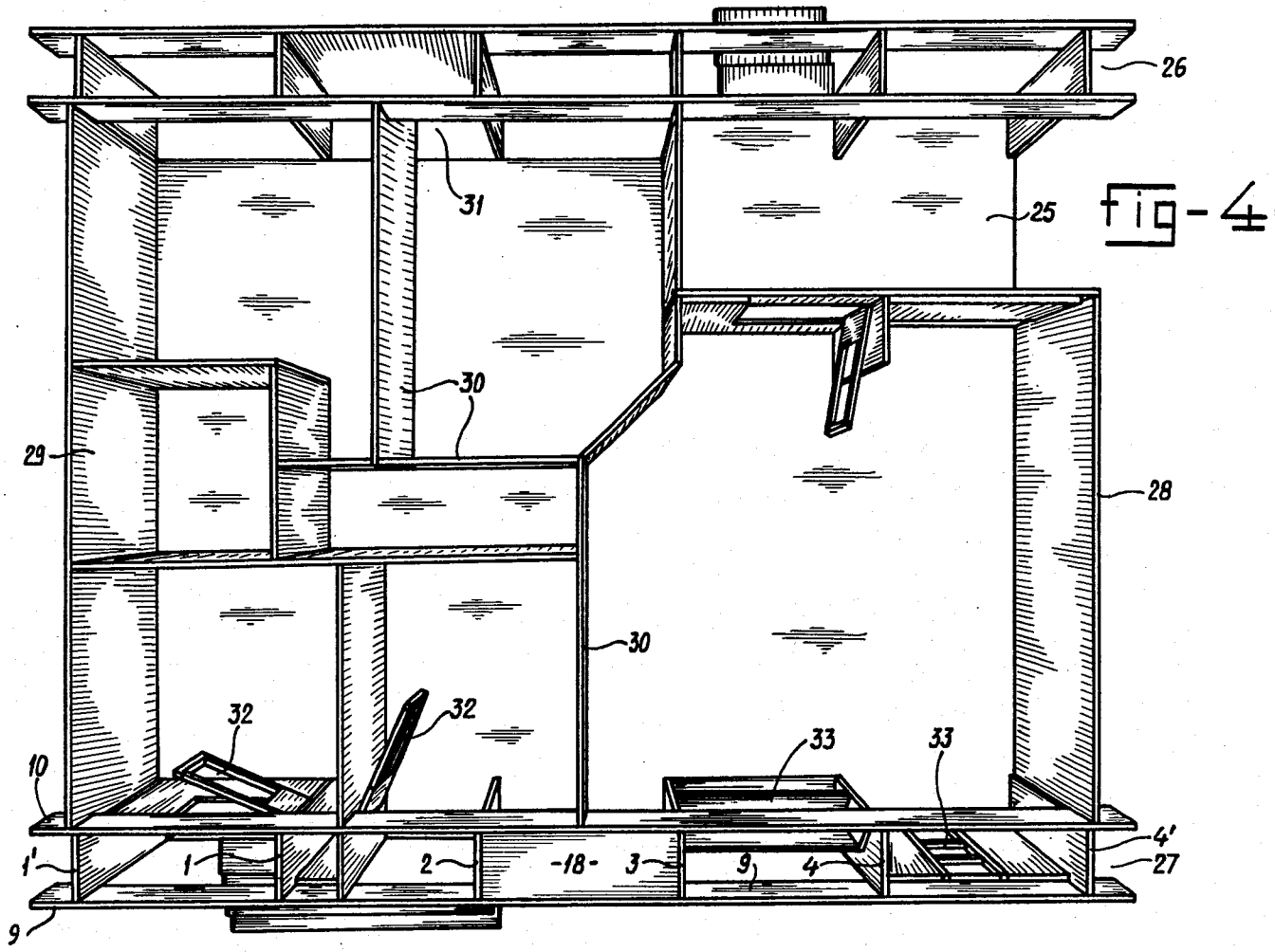
FIG. 4 is a perspective seen from above of a building according to the building system of the invention, of which the roof is taken away.
Figure 5:
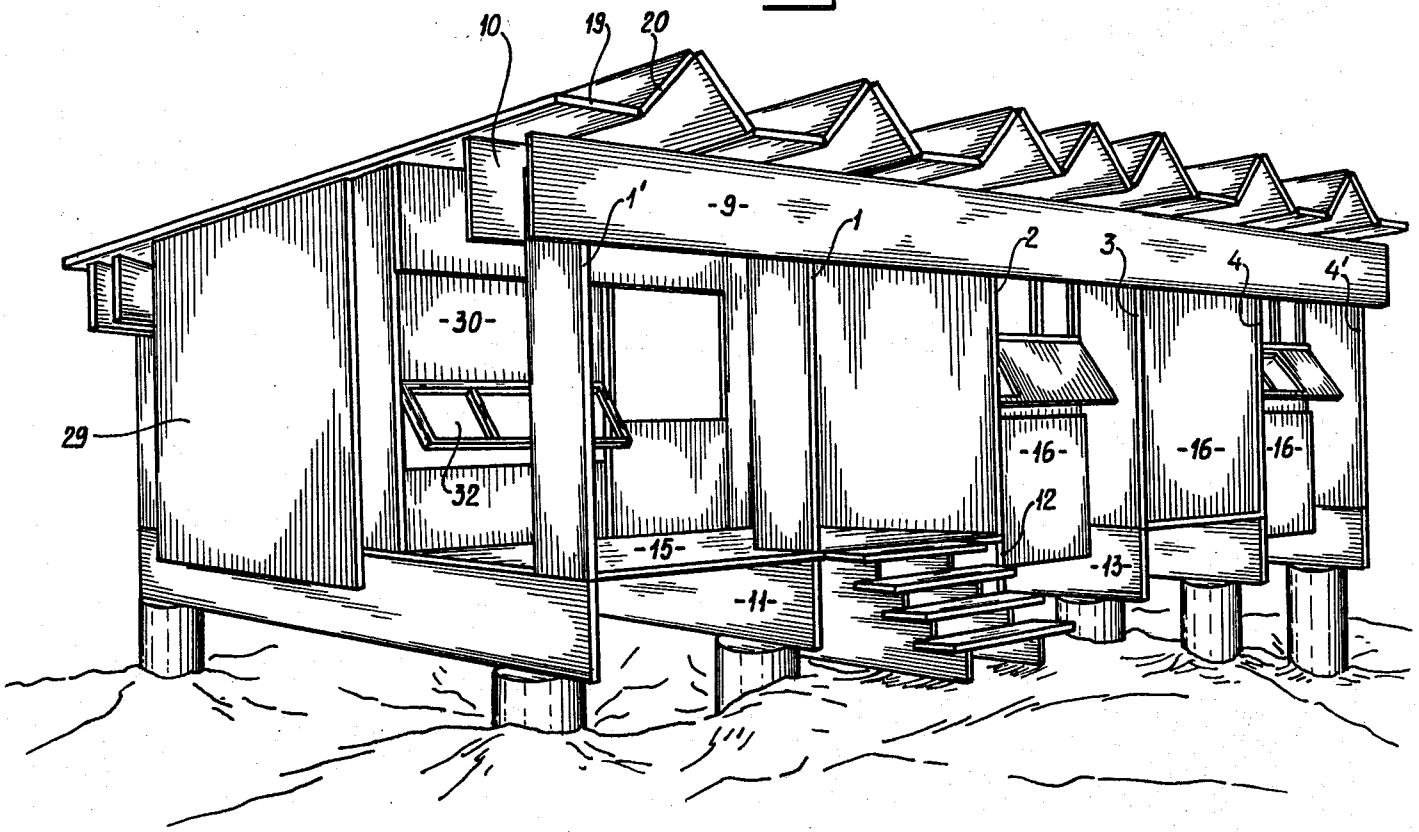
FIG. 5 is a view in perspective of a building obtained with the building system according to the invention.

FIG. 4 shows a building comprising a floor construction 25 on which two supporting elements are positioned, that in general are indicated by 26 and 27. Each element comprises in correspondence with FIG. 1 partitions 1 to 4 inclusive to which still are added the partitions 1' and 4', the plates 9 and 10 and the plate 18, and the plate 16, that are not visible in FIG. 4 but are visible in FIG. 5.

The whole construction further is finished by outer walls 28,29 and a plurality of inner walls 30, that may be provided with door openings and such.

The space between the partitions for instance can be used as a cupboard, as indicated at 31, or for mounting window frames, as indicate by 32 and 33.

From FIGS. 1 to 4 inclusive also is seen clearly, that it is possible to make use in the building system according the invention of parts, that all have the same thickness and may be composed out of the same material.

The building system according to the invention is not restricted to one level. It is possible in case the vertical partitions have a sufficient length, for instance to mount upon each other two layers, in which then these vertical partitions are clamped at several places between two vertical sheets.

I claim:

1. A support wall unit for use as a support element in building construction and to selectively define an internal storage area, said wall unit being defined by rigidly connected elongated planar structural members having opposed faces, opposed linear edges and opposed ends, each structural member being of substantially greater width than thickness, said structural members comprising multiple first members vertically positioned and laterally aligned in parallel vertical planes to define a wall unit depth equal to the width of the first members between the linear edges thereof, said wall unit depth being such as to define a storage area, the opposed ends of said first members constituting upper and lower ends, said structural members comprising second members horizontally positioned and extending in vertical planes along the opposed linear edges of said first members perpendicular thereto, said second members having a vertical width between the opposed linear edges of the second members less than the vertical length between the upper and lower ends of first members, said second members being oriented in at least one opposed pair with the corresponding faces thereof intimately engaged against the opposed linear edges of said first members at the upper ends of the first members, said structural members further comprising third members positioned between and in edge abutting engagement with adjoining ones of said first members within the wall unit depth.

2. The support wall unit of claim 1 wherein at least one of said third members is in a horizontal plane and is of a width equal to the width of the first members and the wall unit depth, said first members, said second members and said at least one of said third members being in mutually perpendicular planes.

3. The support wall unit of claim 2 including at least one additional third member in a vertical plane and positioned between and in edge abutting engagement with adjoining ones of said first members.

4. The support wall unit of claim 3 wherein all of said planar structural members are of the same thickness.

5. The support wall unit of claim 4 wherein all of said planar structural members are of the same width.

6. The support wall unit of claim 5 wherein said structural members are all of hollow core construction.

7. The support wall unit of claim 6 wherein said structural members are filled with isolating material.

8. The support wall unit of claim 1 wherein all of said planar structural members are of the same thickness.

9. The support wall unit of claim 8 wherein all of said planar structural members are of the same width.

* * * * *